US008186187B2

(12) United States Patent
Loughlin et al.

(10) Patent No.: US 8,186,187 B2
(45) Date of Patent: May 29, 2012

(54) DUAL CUSTODY PRIVACY PADLOCK

(75) Inventors: John Loughlin, Lebanon, NJ (US); Robert Loughlin, Stanton, NJ (US)

(73) Assignee: Stanton Concepts, L.L.C., Stanton, NJ (US)

( * ) Notice: Subject to any disclaimer, the term of this patent is extended or adjusted under 35 U.S.C. 154(b) by 0 days.

(21) Appl. No.: 12/875,258

(22) Filed: Sep. 3, 2010

(65) Prior Publication Data

US 2011/0079054 A1 Apr. 7, 2011

Related U.S. Application Data

(60) Provisional application No. 61/248,221, filed on Oct. 2, 2009.

(51) Int. Cl.
*E05B 37/00* (2006.01)

(52) U.S. Cl. ..... 70/21; 70/25; 70/26; 70/38 A; 70/422; 70/432; 70/439; 70/440; 70/DIG. 59

(58) Field of Classification Search ..... 70/21, 25, 70/26, 38 A, 38 B, 284, 285, 422, 432, 439, 70/440, DIG. 59
See application file for complete search history.

(56) References Cited

U.S. PATENT DOCUMENTS 1,401,855 A * 12/1921 Anderson ..... 70/26
4,095,713 A 6/1978 Norton
4,318,234 A 3/1982 Charles et al.
4,386,795 A 6/1983 Charles et al.
4,413,493 A 11/1983 Meinsen et al.
4,685,317 A * 8/1987 DeWalch ..... 70/440
5,556,295 A 9/1996 McFadden et al.
6,035,497 A 3/2000 Jackson
6,112,931 A 9/2000 Booth et al.
6,588,961 B2 7/2003 Lafosse-Marin et al.
6,615,626 B2 * 9/2003 Yu et al. ..... 70/25
6,726,386 B1 4/2004 Gruenacher et al.
7,021,092 B2 4/2006 Loughlin et al.
7,021,848 B1 4/2006 Gruenbacher et al.
7,104,092 B2 9/2006 Yu
7,108,440 B1 9/2006 Gruenbacher et al.
7,114,356 B1 * 10/2006 Yu ..... 70/21
7,119,690 B2 10/2006 Lerch et al.
7,135,973 B2 11/2006 Kittel et al.
7,174,756 B2 2/2007 Ling et al.
7,198,294 B2 4/2007 Welch
7,255,506 B2 8/2007 Gruenbacher et al.
7,273,139 B2 9/2007 Lantz
7,357,007 B2 * 4/2008 Lin ..... 70/21
7,407,188 B2 8/2008 Wildig et al.
7,424,812 B2 * 9/2008 Loughlin et al. ..... 70/21
7,434,426 B2 * 10/2008 Loughlin et al. ..... 70/25
7,434,436 B2 10/2008 Loughlin et al.

(Continued)

*Primary Examiner* — Lloyd Gall
*Assistant Examiner* — David E Sosnowski
(74) *Attorney, Agent, or Firm* — Diehl Servilla LLC

(57) ABSTRACT

A dual function lock having a body, a shackle and a frangible element extending from the body is disclosed. The dual function lock also includes a first locking mechanism within the body wherein when the first locking mechanism is locked, the shackle is in a first position where the toe of the shackle is located within the frangible element so that the shackle cannot be rotated and wherein when the first locking mechanism is unlocked, the shackle can be lifted from the first position so that the toe of the shackle is not within the frangible element so that the shackle can be rotated. Methods of using the lock and a refillable insert of frangible elements are also disclosed.

14 Claims, 9 Drawing Sheets

U.S. PATENT DOCUMENTS

| | | | | |
|---|---|---|---|---|
| 7,530,476 | B2 | 5/2009 | Downey et al. | |
| 7,543,466 | B2 | 6/2009 | Loughlin et al. | |
| 7,579,950 | B2 | 8/2009 | Lerch et al. | |
| 7,628,045 | B2 * | 12/2009 | Yu | 70/21 |
| 7,694,542 | B2 | 4/2010 | Loughlin et al. | |
| 7,712,342 | B2 | 5/2010 | Loughlin et al. | |
| 7,913,526 | B2 | 3/2011 | Loughlin et al. | |
| 7,934,406 | B2 * | 5/2011 | Loughlin et al. | 70/25 |
| 2008/0134729 | A1 * | 6/2008 | Loughlin et al. | 70/22 |
| 2008/0196459 | A1 * | 8/2008 | Yu | 70/285 |
| 2009/0031764 | A1 * | 2/2009 | Huang | 70/21 |
| 2009/0280862 | A1 | 11/2009 | Loughlin et al. | |

* cited by examiner

134

138

DUAL CUSTODY PRIVACY PADLOCK

CROSS REFERENCE TO RELATED APPLICATIONS

The present application claims the benefit of U.S. Provisional Patent Application Ser. No. 61/248,221 filed Oct. 2, 2009. This provisional application is hereby incorporated herein by reference.

BACKGROUND OF THE INVENTION

Conventional locks, such as padlocks employing U-shaped shackles, are extremely popular. One reason for their popularity is the ease and convenience of their attachment to, and fit with, the hasps and other attachment mechanisms or devices with which they are used to provide for the unlatching and opening of a secured assembly of elements.

The locks most frequently in use today rely on a single locking mechanism, most typically being operated by a key. Other locks rely on keyless locking mechanisms, such as combination locks. Notwithstanding, there are applications that require multiple function locks combining both key and combination functions. Multiple function locks typically allow for the opening of the lock by one mechanism independent of the other. This function is known as independent dual custody. A second embodiment requires both mechanisms to function in order to open the lock. This function is known as dependent dual custody.

Today, security concerns, particularly air travel safety mandate that the appropriate authority have access to checked luggage. Many travelers secure their luggage with locks intended for their personal access only. In the absence of the necessary key or combination the authorized security personnel may be required to remove these locks destructively.

Different solutions to the dual custody issues are available. The primary function is the locking of the heel of the shackle and the most popular means is a wheel combination mechanism. This device permits the owner to manipulate the wheels to the correct combination, lift the unlocked shackle from the toe-retaining chamber and rotate the shackle to permit the padlock to be removed from the attachment element. The second means to open the padlock is at the toe and may be by disengagement of the shackle from the toe-retaining chamber by the rotation and/or linear motion of the chamber to provide for the necessary movement of the shackle.

The travel luggage applications involve the security authorities. In the United States this is the Transportation Security Administration (TSA). This authority may cause any installed lock to be removed when deemed appropriate. The key function embodiment represents the currently accepted means to provide the second authority the means to open the padlock.

This key device has proven to be burdensome on the TSA. The lock to be opened and the key required must be identified. The key must be found, inserted in the lock, and manipulated to the unlocked position. The shackle is then lifted from the toe-retaining chamber, rotated to the open position and removed to allow the luggage to be open for the required inspection. After inspection, the lock must be reapplied and locked using the key. During this inspection operation, the key ring is not available to the other inspectors. The air travel environment in the United States involves about 460 airports with more than 4000 inspection stations provided with a key ring of about seven keys, a 24 inch bolt cutter and a pair of side cutting electrician's pliers. The maintenance of teams of trained personnel is a challenge and a faster, simpler, more effective method of securing luggage is a priority for the TSA.

SUMMARY OF THE INVENTION

In accordance with one embodiment of the present invention, a dual function lock is provided. This one embodiment includes a body, a shackle, a frangible element and a first locking mechanism. The body is comprised of a bottom surface and a top surface, where the top surface may comprise multiple levels. The shackle has a heel extending from the body and a toe. The frangible element extends from the body. A portion of the frangible element near the body has a smaller circumference than the remainder of the frangible element outside the body, thereby facilitating detaching of the frangible element. The detaching can be performed in a number of ways, including by detaching. The first locking mechanism may be located within the body.

As used in this application, retaining cup, retaining element, retaining structure, frangible cup, frangible bowl, frangible element, frangible chamber-like element, tamper indicative toe retainer (TITR) are all synonymous in that they all refer to the frangible toe-retaining element of the lock. This element may have multiple embodiments, some of which may resemble a cup or a bowl.

When the first locking mechanism is locked, the shackle is in a first position where the toe of the shackle is located within the frangible element so that the shackle cannot be rotated or lifted. When the first locking mechanism is unlocked, the shackle can be lifted from the first position so that the toe of the shackle is not within the frangible element so that the shackle can be rotated.

The first locking mechanism can be any type of locking mechanism, including a combination lock, a keyed lock, and a robotic key cylinder. The robotic key cylinder can have a recessed notched shaft that is opened with a motorized tool that has a matching notched shaft. Thus, a key cylinder and a motorized tool such as disclosed in co-pending U.S. Pat. Nos. 7,694,542, issued Apr. 13, 2010, and 7,712,342, issued May 11, 2010 and U.S. Pub. No. 2009/0280862, dated Nov. 12, 2009, can be used. U.S. patent application Ser. Nos. 11/186,698, 11/255,659 and 12/474,709 are hereby incorporated herein by reference.

The dual function lock can also include one or more additional frangible elements within the body of the dual function lock that are attached to the frangible element extending from the body. These additional frangible elements are replacements for the frangible element extending from the body. The lock of the present invention is intended to be opened via the first locking mechanism by the owner of the lock using the appropriate combination, key or tool to open the mechanism whereas the frangible element extending from the body is intended to be opened with a cutting tool or detachable by hand. When the frangible element is cut or otherwise detached, then the shackle is free to rotate so that the lock of the present invention can be unlocked.

In accordance with this aspect of the present invention, the lock also includes means for moving the one or more additional frangible elements within the body outside of the body one at a time.

In accordance with another aspect of the present invention, the one or more additional frangible elements are aligned with the frangible element extending from the body.

In accordance with a further aspect of the present invention, the lock can include a dialer having a threaded hole, the rotatable dialer being mounted inside the body and having a portion accessible outside the body such that the dialer can be rotated by the portion accessible outside the body. In accordance with this aspect of the invention, the one or more additional frangible elements each have a spiral groove that mates with the threaded hole such that when the dialer is rotated, one of the one or more additional frangible elements is advanced outside the body. Thus, the dialer provides the means for advancing additional frangible elements outside the body once the first frangible element is cut off or otherwise detached.

The dual function lock, in accordance with further aspects of the invention, can also include a locking plate having a ring and a portion extending from the ring. A notch extends from the ring. The dialer has a toothed section, and the ring of the locking plate is located around the toothed section. The heel of the shackle has a notch that extends toward the toe of the shackle. A spring biases the locking plate toward the heel of the shackle.

In this arrangement, the portion extending from the ring rests on the tab in the heel when the shackle is aligned with the body so that the tab extending from the ring is not located in the toothed section of the dialer thereby allowing the dialer to be rotated. The portion extending from the ring rests on the heel when the shackle is not aligned with the body so that the notch extending from the ring is located within the toothed section of the dialer thereby preventing the dialer from being rotated.

The frangible element can be cup-like or bowl-like or any other shape that can retain the toe. Thus, it can be completely walled or only partially walled. For example, the frangible element can be walled around three-quarters of the cup.

The body of the lock of the present invention can be of any configuration. For example, the portion of the body where the heel extends from is higher than the portion of the body where the frangible element extends from.

The present invention also provides a method of operating a dual function lock. In accordance with an aspect of the method of the present invention, a first locking mechanism on the dual function lock is locked so that a shackle extending from the body of the lock cannot be moved away from the body and such that a toe of the shackle is retained in place by a retaining cup extending from the body of the lock. This is typically performed by the owner of the lock. Then the retaining cup is cut to separate it from the body so that the shackle can be rotated to unlock the dual function lock. This is typically done by an organization that does not own the lock, such as the TSA who is responsible for airport safety, including the inspection of luggage. The TSA preferably uses a cutter tool already available in their standard issue tool box to cut the frangible element.

The method also includes the step of rotating a dial on the dual function lock to cause a new frangible element to extend from the body after a frangible element has been cut from the lock. The new retaining cup retains the toe of the shackle in place when it is extending from the body.

The present invention also contemplates a refill insert for a frangible dual function lock. The insert, in accordance with an aspect of the present invention, includes a plurality of bowl-like (or cup-like) structures linearly attached to each other to form a column of bowl-like structures, each of the plurality of bowl-like structures being at least partially walled. A groove is provided on an outer cylindrical wall of at least some of the plurality of bowl-like structures that forms a groove that spirals down the column of bowl-like structures.

In accordance with other aspects of the present invention, each of the plurality of bowl-like structures is completely walled. At least some of the plurality of bowl-like structures can be sequentially numbered. Further, a section of the column of bowl-like structures between each of the plurality of bowl-like structures can be scored or indented to indicate a cutting area and to assist in the cutting process. Thus, this indented part of the bowl-like structure has a circumference less than other parts of the bowl-like structures to make it easier to cut one of the plurality of bowl-like structures from the column.

In accordance with further aspects of the present invention, a frangible chamber-like element captures the toe of the shackle when engaged in the locked position and is intended to be separated or removed by means of a tool or manually using the fingers. When the engaging chamber has been separated from an assembly of chambers, by a tool for example, the shackle is free to move in rotation about the heel of the shackle, and the open lock disengaged from the attachment.

In accordance with another aspect of the invention, the chamber is part of an assembly of chambers that may be moved along the axis of the shackle to replace the separated chamber. The open shackle may be reattached and engaged with the new chamber. The lock is relocked and security re-established. The means to move the replacement chamber to the proper position for re-engagement may be manual or by the use of a tool. The assembly of chamber elements may be in a single, one time use embodiment or in a replicable multiple use form. This replaceable embodiment may include the operation of the combination mechanism to assure against unauthorized substitution.

DESCRIPTION

Figure 1:
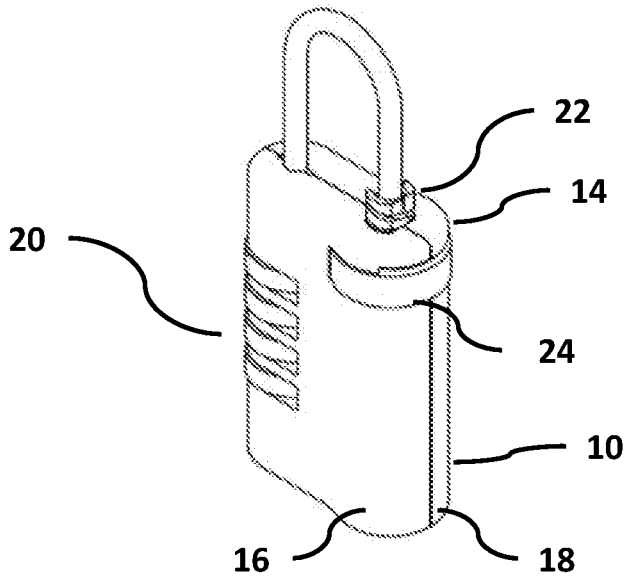
FIGS. 1 to 3 illustrate a dual function privacy lock in accordance with one aspect of the present invention.

Referring to FIG. 1, a multi-function padlock 10 in accordance with an aspect of the present invention is illustrated. The multi-function padlock 10 includes a body 14 formed from a first piece 16 and a second piece 18. A combination lock 20 is illustrated on the left-hand side of the multi-function padlock 10. While a combination lock is illustrated, the locking mechanism could be keyed, a robotic key cylinder that is opened by a motorized tool, or other locking mechanisms. This locking mechanism 20, the first locking mechanism, is controlled by the owner of the multi-function padlock 10.

The padlock 10 may further comprise a second locking mechanism and may be a multi-time use, refillable tamper indicative device (TID) that retains a toe 30 of a shackle 26. In one embodiment of the invention, the second locking mechanism is a frangible element 22. The frangible element 22 extends from the body 14 of the multi-function padlock 10. The multi-function padlock 10, in accordance with an aspect of the present invention, also includes a dial 24 for advancing the frangible element 22. The frangible element 22 can also be referred to as a tamper indicative toe retainer (TITR).

The retaining cup or frangible element 22 is removable with a cutting tool, in accordance with an aspect of the present invention, and provides a second mechanism for opening the multi-function padlock 10. It can also be configurable to be detachable by hand.

Figure 2:
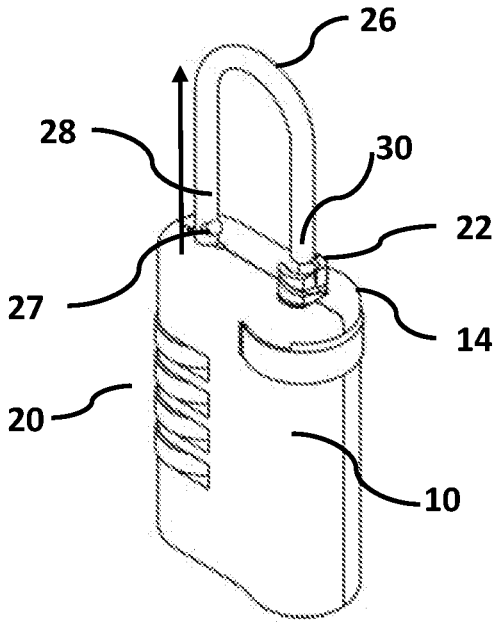
Figure 3:
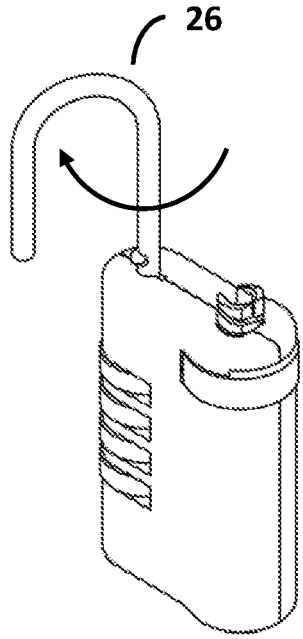

Referring to FIGS. 1 and 2, the operation of the multi-function padlock 10 is illustrated. As shown in FIG. 1, when the combination lock 20 is locked and the shackle 26 is in a down position, the tab 27 in the heel 28 of the shackle 26 is located within the body 14 and the end of the toe 30 of the shackle 26 is located within the retaining cup 22. In this configuration, the shackle cannot be opened as the combination lock 20 keeps the shackle 26 in the down position and the retaining cup 22 prevents the rotation of the shackle. If the combination lock 20 is opened by the user, the combination lock 20 allows the shackle 26 to rise as indicated in FIG. 2. In this configuration, where the shackle is lifted, the tab 27 of the heel 28 can extend above the lock body 14 and the end of the toe 30 extends above the retaining cup 22. When the first locking mechanism is unlocked the shackle can lift and rotate. As illustrated in FIG. 3, the shackle 26 can then be rotated to unlock the multi-function padlock 10.

Figure 4:
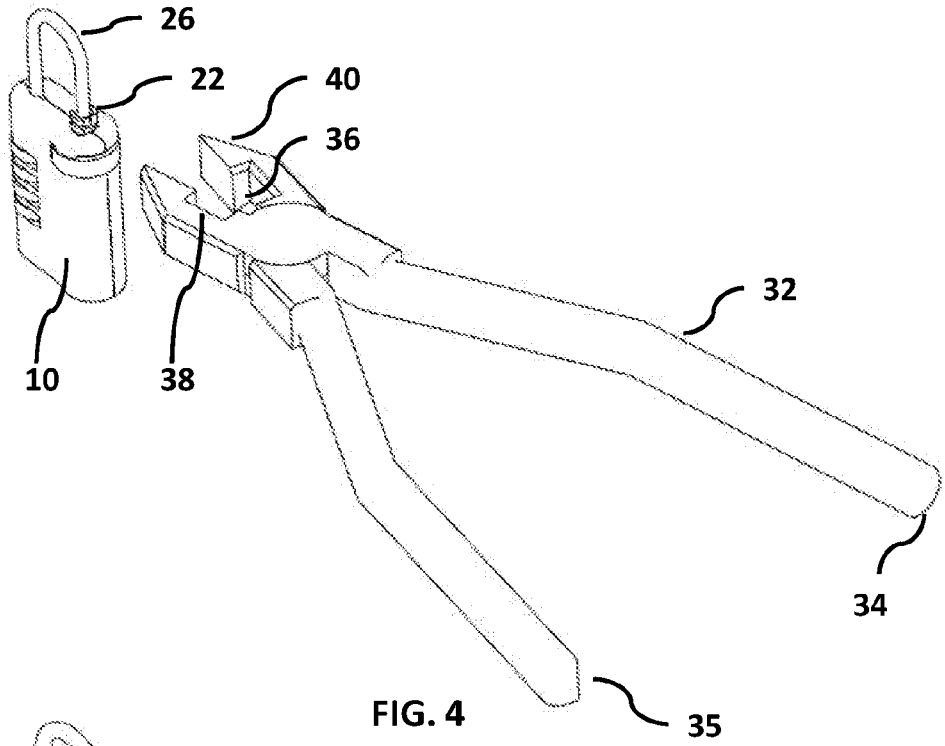
FIGS. 4 and 5 illustrate a dual function privacy lock being opened with a cutting tool in accordance with one aspect of the present invention.
Figure 5:
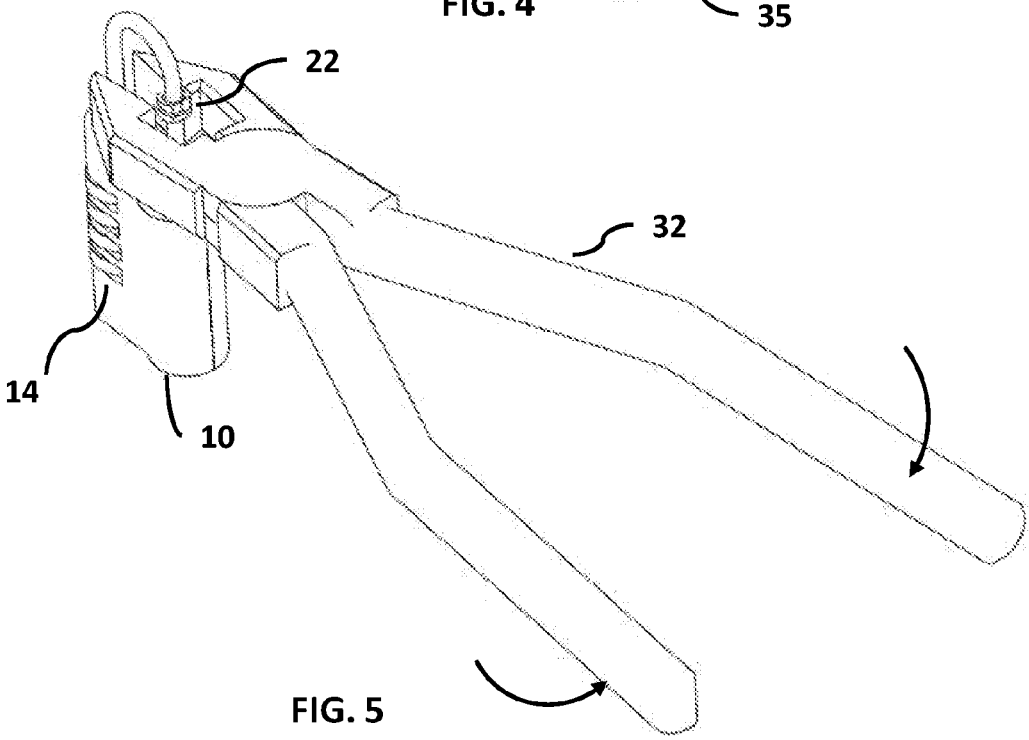

FIGS. 4 and 5 illustrate the opening of the multi-function padlock 10 with a tool 32. In FIGS. 4 and 5, the combination lock 20 is in a locked position so that the shackle 26 cannot be lifted and rotated. In other words, the retaining cup 22 is holding the shackle 26 in place against any rotation. If an authorized organization, such as the TSA, desired to open the lock 10, for example to examine luggage, the tool 32 is utilized to cut the frangible element 22. To release the toe, the TITR is detached at a specific location. The TITR may be detached manually without the use of a tool, or it may be detached with a cutting tool. The TITR may be marked to indicate that it has been detached.

The tool 32 is a cutting tool having handles 34 and 35 and cutting edges 36 and 38 near its head 40. A preferred tool is an 8 inch side cutting electrician pliers, although other cutting tools can be used. It is believed that the 8 inch side cutting electrician pliers are part of the TSA's standard issue toolbox. Thus, no special tool is needed by a government entity, such as the TSA, to open the multi-function padlock 10 in accordance with an aspect of the present invention.

As shown in FIG. 5, once the cutting tool 32 is used to cut the frangible element 22, the frangible element can travel up the shackle. Thus, the frangible element 22, which is no longer attached to body 14 of the lock 10 in anyway, no longer restricts the shackle 26 from rotating. Thus, the lock 10 can be opened once the frangible element 22 has been detached.

Figure 6:
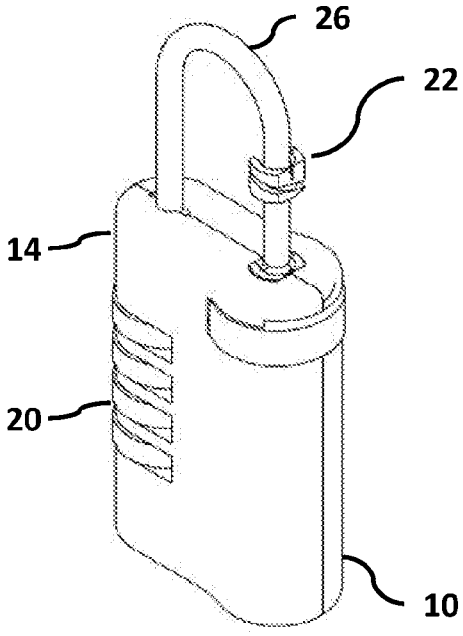
FIG. 6 illustrates a severed frangible element segment in accordance with one aspect of the present invention.

FIG. 6 illustrates a severed frangible element segment 22 in accordance with one aspect of the present invention. As illustrated, the severed frangible element 22 has a numeral "1" printed on it. This indicates to the owner which frangible element was used by the owner to lock the lock. So, for example, if the owner locked the lock with a frangible element 22 marked "1" but received the luggage after a flight with a frangible element with a different number such as "2," then the owner would know that the lock had been opened. Alphabet or other special characters could also be used to mark the cups, as could color codes.

Figure 7:
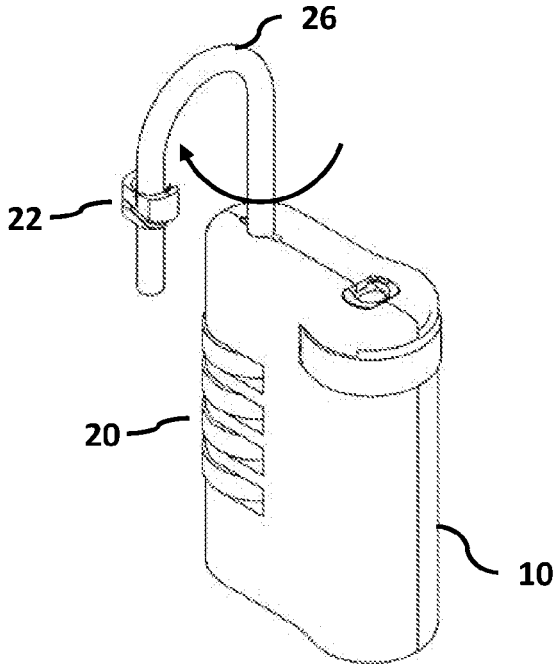
FIGS. 7 to 9 illustrate the operation of a dual privacy lock when the frangible element is severed in accordance with one aspect of the present invention.

FIG. 6 further illustrates that once the frangible element 22 is detached, it separates from the body 14 of the lock 10. It can be pushed up the shackle 26, as illustrated. FIG. 7 illustrates that the shackle 26 can be rotated once the frangible element 22 is detached, which means the toe 30 is free and the shackle 26 can rotate about the heel 28, thereby allowing the lock 10 to be unlocked even if the first locking mechanism 20 is still locked.

Figure 8:
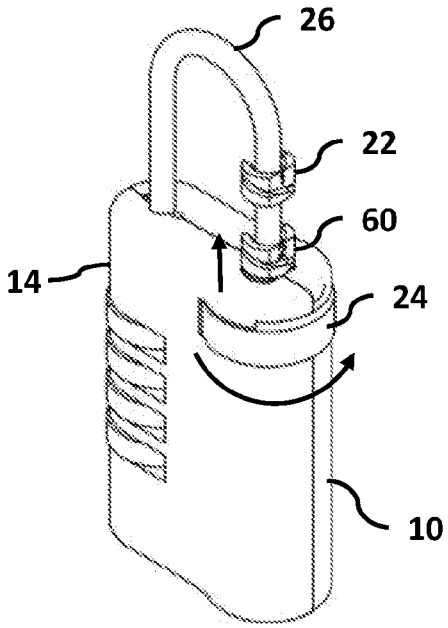
Figure 9:
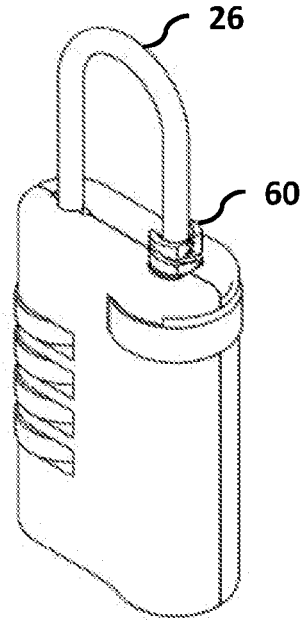

FIGS. 8 and 9 illustrate further operations of a dual privacy lock 10 in accordance with further aspects of the present invention. In FIG. 8, the detached frangible element 22 is left on the shackle 26 while the shackle is returned to a position that is aligned with the body 14 of the lock 10. The severed TITR section 22 can be left on the shackle 26 for the owner to remove or can be discarded at the time of severing. When the toe 30 is returned to its home position, the dial 24 can be turned to advance the TITR 22 to its next section marked "2" in FIG. 8. This provides evidence that the second locking mechanism has been functioned, maybe by an authorized entity such as the TSA (Transportation Security Agency) or maybe by an un-authorized person. The dialer 24 is rotated as indicated and a new frangible element 60 rises from within the body 14 of the lock 10. If the shackle 26 is aligned properly, the new frangible element 60 surrounds the toe end 30 of the shackle 26 to prevent the shackle 26 from being rotated, thereby locking the lock 10. FIGS. 8 and 9 illustrates this process, however, in FIG. 9 the first frangible element 22 has been removed from the shackle 26 after it has been detached so that only the new frangible element 60 is shown. The new frangible element 60 is connected to the body 14 in a manner, described below, so that it prevents the shackle 26 from being rotated.

Figure 10:
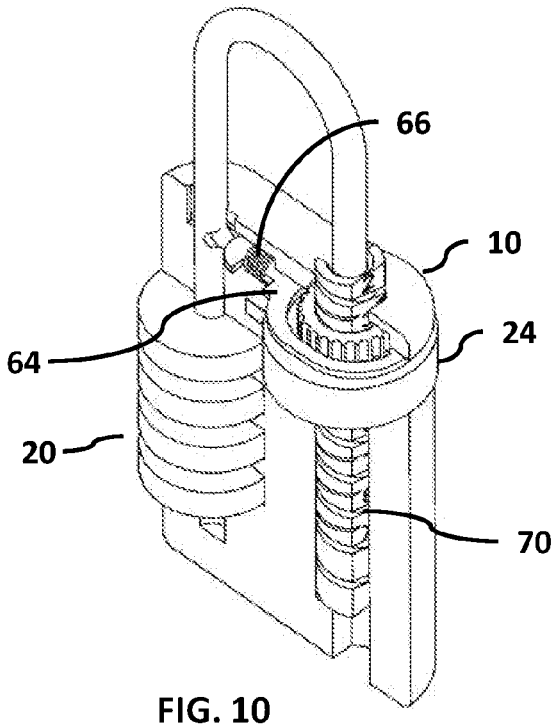
FIGS. 10 to 14 illustrate the internal components of a dual privacy lock in accordance with one aspect of the present invention.
Figure 11:
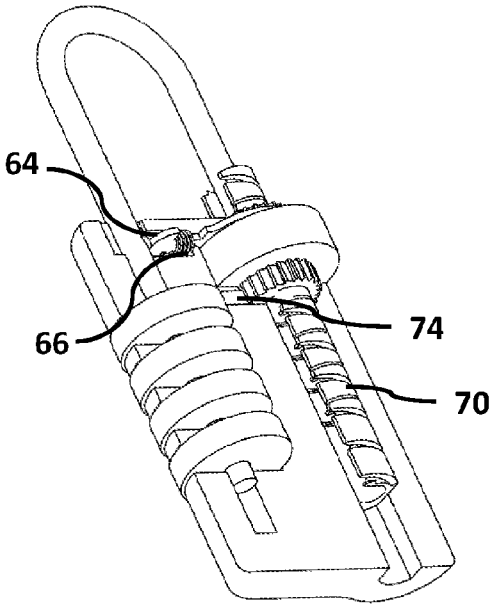
Figure 12:
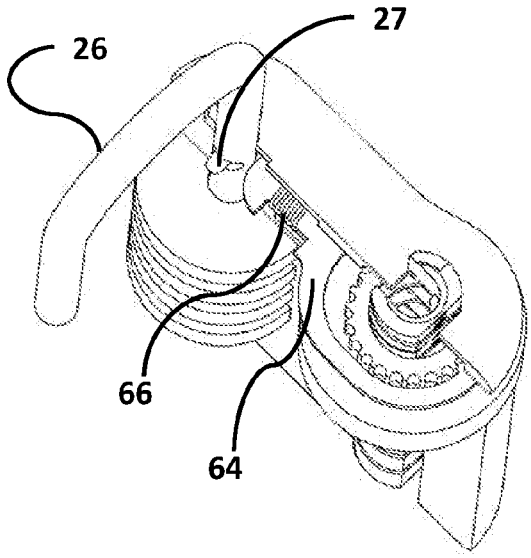

FIGS. 10 to 12 illustrate the internal components of a dual privacy lock 10 in accordance with one aspect of the present invention. These components include the dialer 24, a locking structure 64, a compression spring 66 and a leaf spring 74. Additionally a refillable insert of severable frangible elements 70 is provided.

Figure 13:
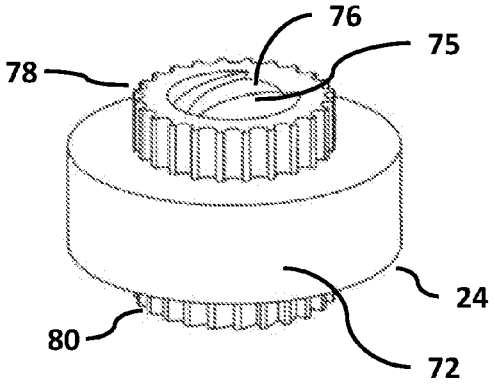

FIG. 13 illustrates the dialer 24 for the second locking mechanism in greater detail. The dialer 24 has a finger wheel section 72 that is designed to be turned with the fingers. It can also be designed to be turnable only with a special tool. The center of the dialer 24 has a hole 75 in which the refillable insert of severable frangible elements 70 can fit. The hole 75 is threaded 76. Shown is a left hand thread, but a right hand thread could be used The dialer 24 has a circumferential section 78 above the finger wheel section 72 that has a plurality of teeth. The dialer 24 also has a circumferential section 80 below the finger wheel section 72 that also has teeth. The teeth on dial mesh with the tab 84 on locking plate 64 to prevent rotation when toe 30 is not in home position. A ratchet allows the TITR 70 to be advanced only by the dial 24. The form of the dial 24 allows it to be captured in the lock body 14 when left and right sides are assembled.

Figure 14:
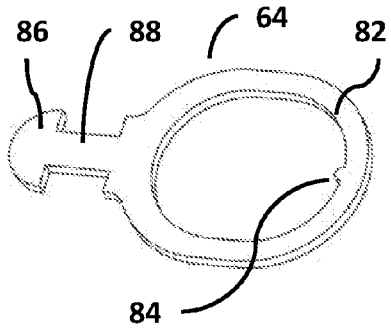

FIG. 14 illustrates the locking structure 64 in greater detail. The locking structure 64 includes a ring section 82 that has an inward extending notch 84. The locking structure 64 also includes a portion 86 that extends away from the ring section 82.

When these components are configured in the body 14 of the lock 10, as illustrated in FIGS. 10 to 12, they operate to allow the dialer 24 to be turned so as to advance a new frangible element out of the body 14 of the lock 10. The dialer 24 is located in a cavity in the body 14. The refillable insert of frangible elements 70 is also located in a channel in the body 14 of the lock such that the insert runs through the hole 75 in the dialer 24. As will be shown later, the outer portion of the insert 70 is grooved so as to mate with the thread 76 in the hole 74 of the dialer 24.

As shown in FIG. 11, one end of a leaf spring 74 is provided in a relief in the body 14 of the lock 10. The other end of the leaf spring 74 interfaces with the teeth in the section 80 of the dialer 24. The leaf spring 74 operates to allow the dialer 24 to be turned only in one direction so as to lift the inset 70 so that a new frangible element is outside the body 14. Thus, the interface of the leaf spring 74 with the teeth in the section 80 of the dialer prevents the dialer 24 from being turned in a wrong direction that would cause the retraction of a frangible element from outside the body 14 of the lock 10 to a position inside the body 14. The leaf spring 74 therefore prevents the lock 10 from being unlocked in an inappropriate manner.

As shown in FIGS. 10 and 12, the ring 82 of the locking structure 64 is positioned around the toothed section 78 of the dialer 24. The portion 86 of the locking structure 64 extending away from the ring 82 is pointed toward the heel of the shackle 26. The compression spring keeps the locking plate in contact with the shackle. The tab 27 on the heel 28 of the shackle 30 provides means to cam the dial locking plate 64, so that the dial can only turn when the toe 26 is in the home position. When the toe 26 is not in the home position the dial is locked and cannot turn. This feature prevents the user of either the first or second locking mechanism from advancing the TITR 22 inadvertently to avoid a lock out of the toe. The end of the portion 86 interfaces with the tab 27 when the shackle 26 is in a locked position such that the shackle 26 is in its down position and the shackle 26 is aligned with the body 14 of the lock. When in this position, the compression spring 66, which is located around area 88 of the locking structure 64, is compressed, and the dial locking plate 64 is positioned so that the notch 84 is not located in any of the teeth in the section 78 of the dialer. Thus, the dialer 24 can be turned in this position, but the dialer 24 cannot be turned when the dialing plate 64 is in the locked position.

The dialer 24, of course, can only be turned if there is no frangible element located outside the body 14 of the lock 10. If there was a frangible element already outside the body 14, then the bottom of the frangible element would hit the toe 30 of the shackle 26, preventing further advancement of the frangible element, thereby preventing further rotation of the dialer 26.

When the shackle 26 is rotated so that it is not aligned with the body 14 of the lock 10, the tab 27 is no longer in contact with the portion 86 of the locking structure 64. The compression spring 66 biases the locking structure towards the shackle 26 so that the end of the portion 86 of the locking structure actually rests against the heel 28 of the shackle 26. In this position, the notch 84 of the locking structure 64 is located within the teeth of the section 78 in the dialer 26. This orientation prevents the dialer 24 from being rotated when the shackle is not aligned with the body 14 so that new frangible elements cannot extended outside the body 14 of the lock 10 unless the shackle 26 is properly positioned.

Figure 15:
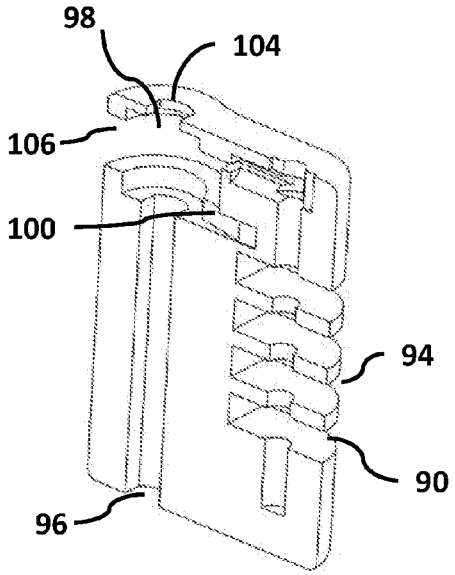
FIGS. 15 and 16 illustrate the body components of a dual privacy lock in accordance with one aspect of the present invention.
Figure 16:
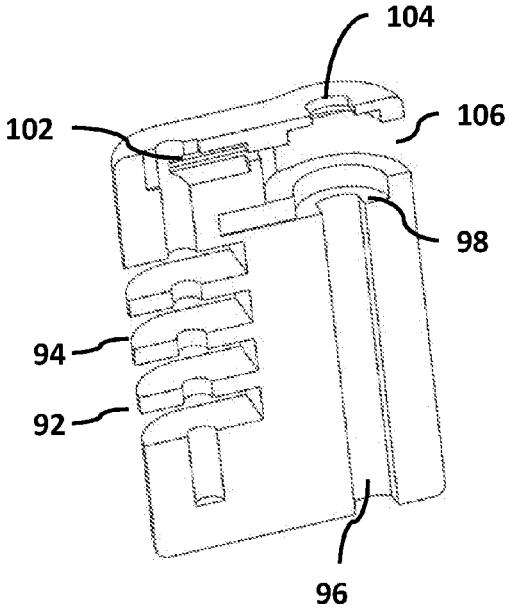

FIGS. 15 and 16 illustrate the body components 90 and 92 of a dual privacy lock 10 in accordance with one aspect of the present invention. The lock 10, in accordance with one aspect of the present invention, is made with two halves 90 and 92. Each half 90 and 92 has an area 94 to accommodate a first locking mechanism 20. Areas for a combination lock are shown, but other configurations to allow the use of other types of locks can be provided. Each half 90 and 92 has a channel 96 to allow inserts 70 of frangible elements to be inserted into the dialer 24. This channel 96 for the TITR 70 is shaped to enable linear motion of the TITR 70. Each half 90 and 92 also has a cavity 98 for the dialer 24. A relief 100 for the leaf spring 74 is provided. A slot 102 for the compression spring 66 is also provided to allow translation of locking plate and cavity for compression spring. Openings 104 through which the frangible elements extend are also provided in each half 90 and 92. Additionally, openings 106 for the finger wheel 72 section of the dialer 24 are also provided so that the dialer is accessible outside the body 14 of the lock 10. The left side 90 and right side 92 can be assembled together by welding, rivets, etc.

Figure 17:
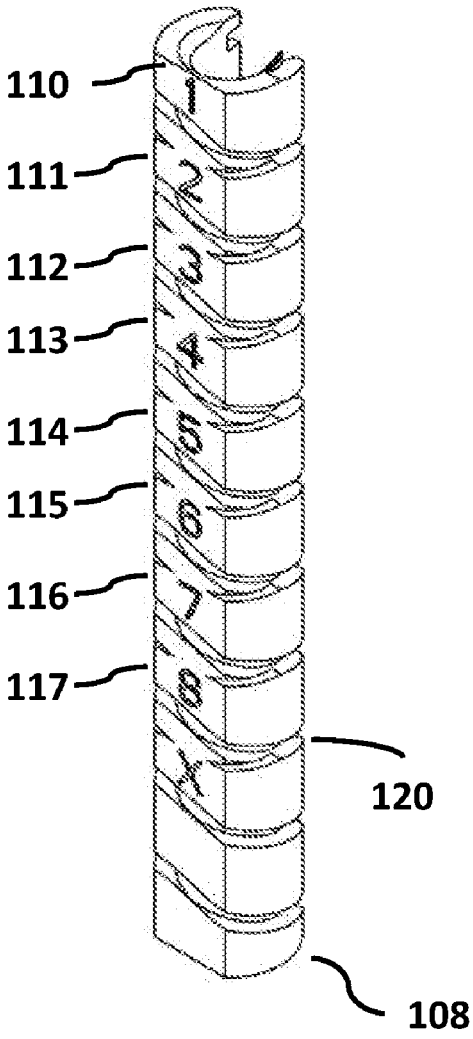
FIGS. 17 to 21 illustrate a replacement segment of frangible elements in accordance with one aspect of the present invention.

FIGS. 17 to 21 illustrate replacement segments of frangible elements in accordance with various aspects of the present invention. FIG. 17 illustrates an insert 108 of a plurality of frangible elements 110 to 117. A variety of number of frangible elements can be provided. In between each of the frangible elements 110 to 117, in accordance with one aspect of the present invention, the circumference or diameter of the insert 108 is less than the circumference or diameter of the main portion of each of the frangible elements 110 to 117. This is the area in which the cutting tool is intended to cut the frangible element or the point at which the user is intended to manually detach the frangible element. The groove is to identify clipping location and facilitate required severing mechanics and clean breaks between segments. In other aspects of the present invention, a marking around each of the frangible elements can be provided to indicate the location where the frangible element should be cut. Thus, each frangible element would have a line marking the end of one frangible element and the start of another frangible element. The line can be marked around the circumference of each frangible element, so that an insert of frangible elements would have a plurality of circumferential lines. Although eight segments are used in the embodiment shown in FIG. 17, it is anticipated that TITR's 70 with other quantities of segments could be used. Also, a new TITR 70 can be installed after the eighth segment is removed. In cases where the frangible element is to be hand detached, the groove would be engineered so that the frangible element can be easily removed by hand. For example, the groove might be made deeper so that there is less material holding the individual frangible elements together and so that a minimal amount of force is needed to separate the frangible elements. If the frangible element is to be cut off, the groove might simply be an indicator that shows where the cutting tool should be placed.

Also, there is a groove 120 that forms a helix that runs around the outside of the insert 108. The groove 120 is pitched 0.175 inch per thread and mates with the thread 76 inside the hole 75 in the dialer 24. With this arrangement, one turn of the dialer 24 advances one frangible element of the insert 108. Of course, any pitch can be used. The thread should mate with the thread in dial 24 to advance TITR 70.

In accordance with one aspect of the present invention, each of the frangible elements 110 to 117 in the insert 108 are numbered for the reasons previously discussed, including to indicate tampering. The markings can be alpha numeric or color coded. Additionally, the shape of the insert 108 matches the bore 96 in the body 14 of the lock 10. A non circular, asymmetric shape of the insert 108 will prevent unwanted rotation of the insert 108.

Figure 18:
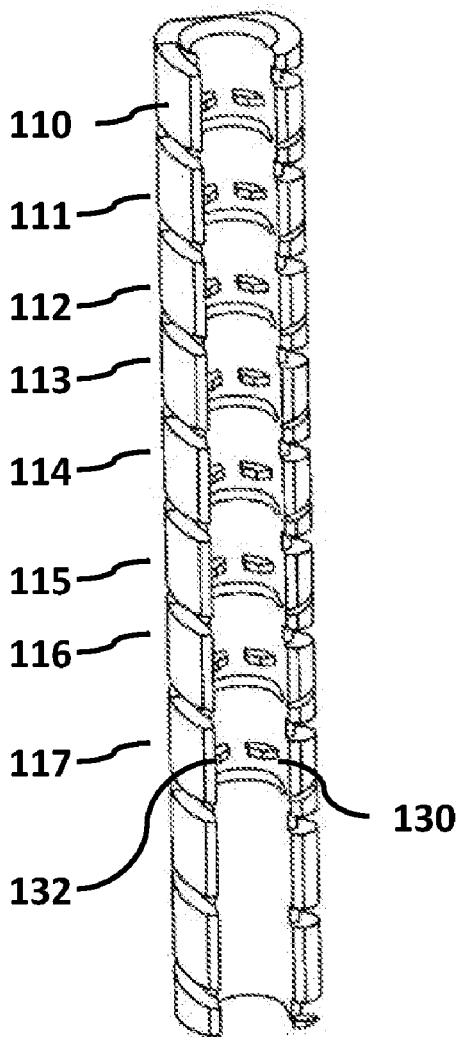

The shape of the wall of each of the frangible elements 110 to 117 must be such that it prevents the shackle 26 from rotating when the locking mechanism 20 is in the locked position and the shackle 26 is in its down position. Thus, the entire outside section of the frangible elements 110 to 117, or any frangible element used in the present invention, can be entirely walled. Alternatively, the outside section of the frangible elements can be partially walled. For example, the outside section of each frangible element can be three-quarters walled. This is illustrated in FIG. 18, where each of the frangible elements are approximately three-quarters walled.

The shape of the column corresponds to the TITR bore 96 on the lock body 14. Asymmetry, as shown in FIG. 17, prevents rotation. Additional features can be employed to assure the assembled orientation of the TITR 70 such that the segment numbers face outward.

The frangible elements can also have a bottom, as a normal cup would. However, the bottom can be replaced with tabs, as illustrated in FIG. 18. In FIG. 18, two tabs 130 and 132 are provided on the interior wall of each frangible element 110 to 117. These tabs 130 and 132 provide the same function as a bottom would. The tabs 130 inside the bore limit the advancement to one segment. When cut the exposed segment is forced upwards against the immovable toe 30 of the shackle, the upward force will break the tab 130. When the dialer 24 is turned, the next frangible element in an insert advances until the tabs 130 and 132 meet the end of the toe 30 of the shackle 26, blocking further advancement. This embodiment of TITR is open on one side to facilitate manufacture by molding. TITR can be metallic or non-metallic or a composite. TITR could also be assembled from discrete segments bounded together via adhesive, ultra sonic welding, press fitting, etc. After the eighth segment there are no tabs so the TITR 70 can advance free of the dial and lock body at which point the spent TITR 70 can be removed from the lock assembly and a new one can be installed.

Figure 19:
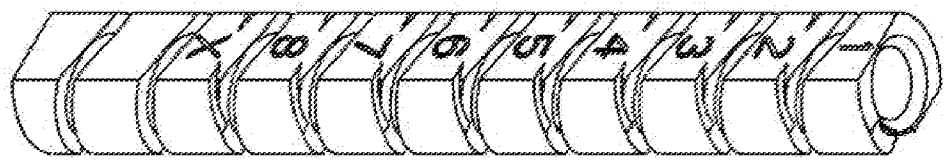
Figure 20:
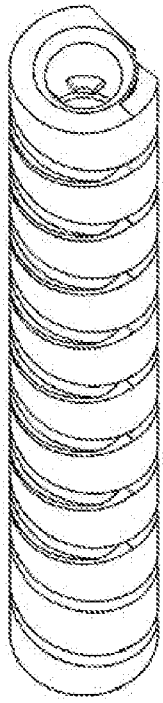
Figure 21:
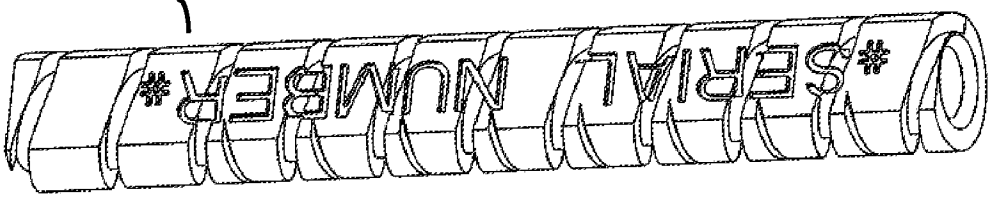

FIG. 19 illustrates an insert 134 of frangible elements wherein each of the frangible elements has a complete wall. FIG. 19 illustrates a TITR 70 with a fully enclosed bore. FIG. 20 illustrates an insert 136 of frangible elements with additional asymmetry. So, for example, in FIG. 19, there are two flat sides of the insert whereas in FIG. 20 there is only one. FIG. 21 illustrates the placement of a serial number on an insert 138 of frangible elements. The serial number provides additional security and could preclude an unauthorized replacement of a frangible element. The arrangement of FIG. 21 conceals the serial number with the lock body making the replacement of the insert with a non-authorized insert more difficult. In place of a serial number, a text string that is personalized, for example, with someone's name could be used.

A hole is provided in the bottom of the body 14 of the lock 10 to allow a new insert to be inserted into the bore 96 of the body 14. The hole can be capped with a removable seal. Alternatively, the body 14 can be made so that there is no hole for replacement inserts or the hole can be permanently sealed so that the lock 10 is sold as a "throw-away" device. In this configuration, once all of the frangible elements are used, the lock 10 is disposed of. With the open bore, replacement inserts can be purchased separately from the lock and inserted into the lock 10 when needed.

Figure 22:
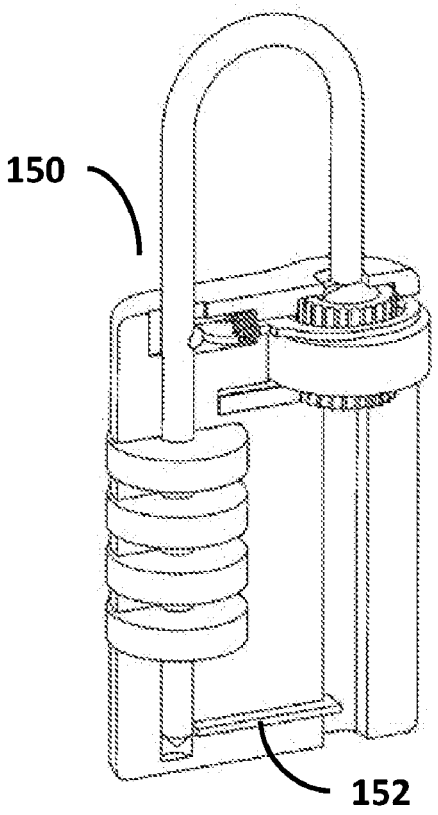
FIGS. 22 and 23 illustrate the use of a blocking member in a dual privacy lock in accordance with one aspect of the present invention.
Figure 23:
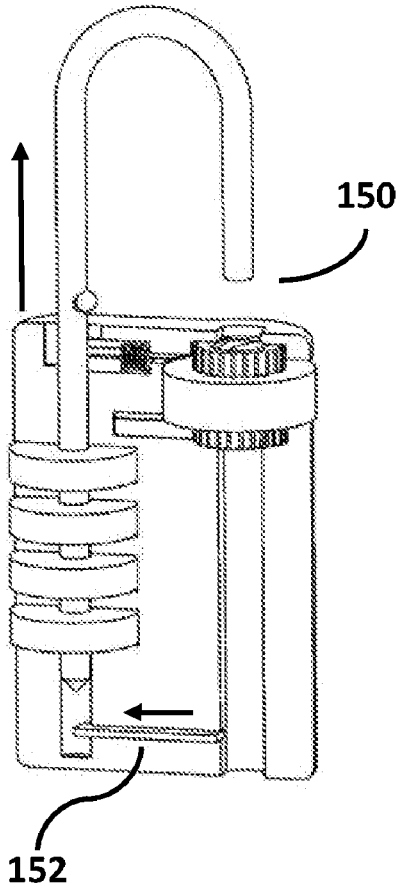

FIGS. 22 and 23 illustrate the use of a blocking member 152 in a dual privacy lock 150 in accordance with one aspect of the present invention. The lock may incorporate a blocking member 152 to prevent installing a new TITR 70 without the first locking mechanism being unlocked. The blocking member 152 engages a part of the shackle when the shackle is in its down position and locked. This position biases the blocking member 152 to block the bore in the body in which the insert of frangible elements is placed. Thus, a new insert of frangible elements can be inserted into the lock only when the first locking mechanism is unlocked. This prevents a maleficent form installing an unauthorized insert 70. When the shackle is lifted after the first locking mechanism is unlocked, the blocking member 152 is biased out of, or retracted from, the bore in which the insert of frangible elements is inserted so that a new insert of frangible elements can be inserted.

Figure 24:
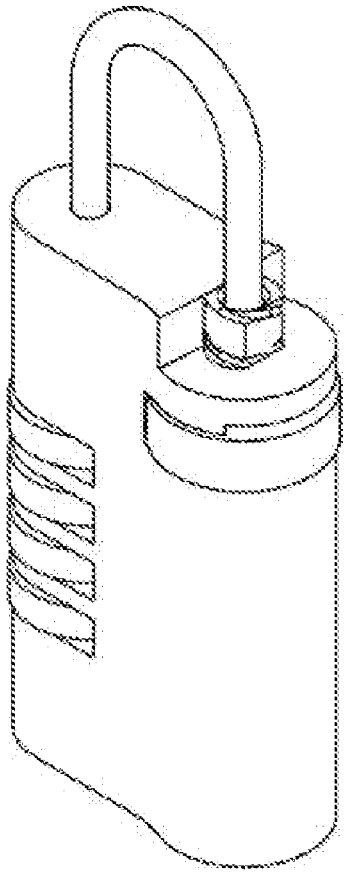
FIGS. 24 and 25 illustrate a dual function privacy lock in accordance with further aspects of the present invention.
Figure 25:
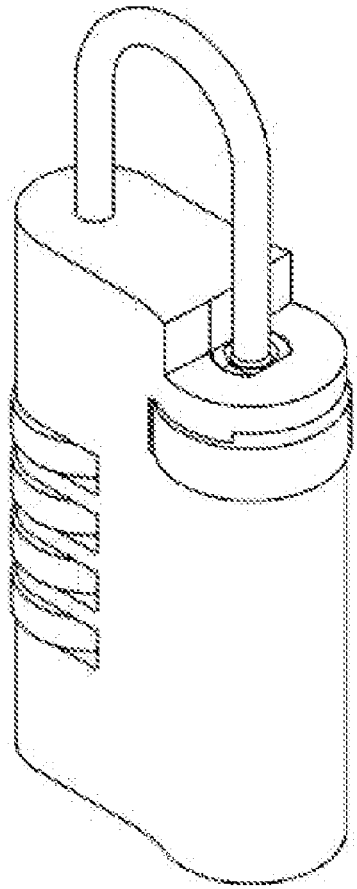

Various body configurations can be used in accordance with other aspects of the present invention. FIGS. 24 and 25 illustrate an alternate body configuration that can be used. There are many other body configurations that are possible. Referring to FIGS. 24 and 25, a body configuration where the toe of the shackle engages the frangible element at a level below a top surface of the lock. As shown in FIG. 25, once the frangible element is detached, the shackle can be rotated to unlock the lock. In this embodiment, when the first locking mechanism is locked and the frangible element is detached, the shackle 26 rotates about the heel 28 and the toe 30 does not make contact with the wall formed from the recess of the lock body 14.

A dialer has been shown as one way of advancing a frangible element. Other methods and structures can be used. For example, a slider, such as the slider used on box cutters to advance new blades, can be used in place of a dialer.

It is believed that the dual function lock in accordance with various aspects of the present invention will: reduce the operating costs of the TSA by providing a faster and simpler means to inspect luggage; provide the traveling public with a more secure padlock that overcomes the vulnerability of millions of padlocks being open by the same, easily reproduced key; and reduce manufacturing costs.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

We claim:

1. A dual function lock, comprising:

a body;

a shackle having a heel extending from the body and a toe;

a frangible element extending from the body, a portion of the frangible element nearer to the body having a smaller perimeter than a remainder of the frangible element outside the body;

a first locking mechanism within the body;

wherein when the first locking mechanism is locked, the shackle is in a first position where the toe of the shackle is located within the frangible element, and the shackle cannot be rotated or lifted;

wherein when the first locking mechanism is unlocked, the shackle can be lifted from the first position so that the toe of the shackle is not within the frangible element, and can be subsequently rotated;

one or more additional frangible elements within the body of the dual function lock and attached to the frangible element extending from the body; and means for moving the one or more additional frangible elements within the body outside of the body one at a time.

2. The dual function lock of claim 1, wherein when the frangible element extending from the body is removed, the shackle can be rotated.

3. The dual function lock of claim 1, wherein the frangible element extending from the body has a wall section that at least partially surrounds the toe of the shackle when the first locking mechanism is locked, and the frangible element extending from the body has one or more tabs extending inwardly from the wall section.

4. The dual function lock of claim 1, wherein the first locking mechanism is selected from the group consisting of a combination lock, a keyed lock, and a robotic key cylinder.

5. The dual function lock of claim 1, wherein the one or more additional frangible elements are aligned with the frangible element extending from the body.

6. The dual function lock of claim 1 further comprising:

a dialer having a threaded hole, the dialer being mounted inside the body and having a portion accessible outside the body such that the dialer can be rotated by the portion accessible outside the body;

the one or more additional frangible elements each having a spiral groove that mates with a threaded hole such that when the dialer is rotated, one of the one or more additional frangible elements is advanced outside the body.

7. The dual function lock of claim 6, further comprising:

a locking plate having a ring, a notch extending from the ring and a portion extending from the ring;

the dialer having a toothed section, the ring being located around the toothed section;

the heel of the shackle having a notch that extends toward the toe of the shackle; and a spring that biases the locking plate toward the heel of the shackle;

wherein the portion extending from the ring rests on the notch in the heel when the shackle toe is aligned with the frangible element extending from the body and the notch extending from the ring is not located in the toothed section of the dialer thereby allowing the dialer to be rotated; and wherein the portion extending from the ring rests on the heel when the shackle is not aligned with the body and the notch extending from the ring is located within the toothed section of the dialer thereby preventing the dialer from being rotated.

8. The dual function lock of claim 1, wherein the frangible element extending from the body is completely walled.

9. The dual function lock of claim 1, wherein the frangible element extending from the body is partially walled.

10. The dual function lock of claim 1, wherein the frangible element extending from the body is walled around three-quarters of a cup formed by the frangible element extending from the body.

11. The dual function lock of claim 1, wherein the shackle and the frangible element extending from the body extend from the body in the same direction and the portion of the body where the heel extends from is higher than the portion of the body where the frangible element extending from the body extends from.

12. A method of operating a dual function lock, comprising:

locking a first locking mechanism on the dual function lock so that a shackle extending from a body of the lock cannot be moved away from the body and such that a toe of the shackle is retained in place by a retaining element extending from the body of the lock, wherein the retaining element has a portion nearer to the body that has a smaller perimeter than a remainder of the retaining element outside the body; and detaching the retaining element so that the shackle can be rotated, and rotating a dial on the dual function lock to cause a new retaining element to extend from the body.

13. The method of claim 12, wherein when the shackle is in a locked position and the new retaining element has been fully extended from the body, the new retaining element retains the toe of the shackle.

14. A dual function lock, comprising:

a body;

a shackle having a heel extending from the body and a toe;

a plurality of frangible elements linearly connected to each other, one of the plurality of frangible elements extending from the body while the remaining frangible elements are located inside the body, a line being marked at an interface between connected frangible elements;

a first locking mechanism within the body;

wherein when the first locking mechanism is locked, the shackle is in a first position where the toe of the shackle is located within the one of the plurality of frangible elements so that the shackle cannot be rotated; and wherein when the first locking mechanism is unlocked, the shackle can be lifted from the first position so that the toe of the shackle is not within the one of the plurality of frangible elements so that the shackle can be rotated.

* * * * *